US007086406B2

(12) United States Patent
Jung et al.

(10) Patent No.: US 7,086,406 B2
(45) Date of Patent: Aug. 8, 2006

(54) DEVICE FOR MEASURING THE TURBIDITY OF THE RINSING LIQUID IN A DISHWASHER

(75) Inventors: Clemens Jung, Bruecken (DE); Peter Schwarzweller, St. Wendel (DE); Konrad Petry, Mandelbachteil 3 (DE); Reinhold Baltes, Roschberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 334 days.

(21) Appl. No.: 10/713,304

(22) Filed: Nov. 14, 2003

(65) Prior Publication Data

US 2004/0163679 A1 Aug. 26, 2004

(30) Foreign Application Priority Data

Nov. 14, 2002 (DE) ..... 102 53 009

(51) Int. Cl.
*B08B 3/02* (2006.01)

(52) U.S. Cl. ..... 134/56 D; 134/57 D; 134/58 D

(58) Field of Classification Search ..... 134/57 D, 134/58 D, 56 D
See application file for complete search history.

(56) References Cited

U.S. PATENT DOCUMENTS 3,279,481 A * 10/1966 Neyhouse et al. ..... 134/57 D
5,589,935 A * 12/1996 Biard ..... 356/339
5,803,985 A * 9/1998 Alvord ..... 134/18
5,924,432 A * 7/1999 Thies et al. ..... 134/56 D

* cited by examiner

*Primary Examiner*—Michael Barr
*Assistant Examiner*—Saeed Chaudhry
(74) *Attorney, Agent, or Firm*—Clifton G. Green; Robert O. Rice; John F. Colligan

(57) ABSTRACT

The invention relates to a device for measuring the turbidity of the rinsing liquid in a dishwasher by means of a turbidity sensor. If it is provided according to the invention that the turbidity sensor is incorporated into the inlet flow of the circulation pump into the water drain shaft of the dishwasher and continuously measures the turbidity of the rinsing liquid, that the upper and lower spraying plane can be operated alternately, that a difference value can be derived from the turbidity values associated with upper and lower spray plane, that parameters for the quantity and the type of soiling can be derived from the turbidity values and the difference value and that the further rinse program can be established and controlled with these parameters, then, with low complexity, measurement values for the degree of soiling can be obtained, from which value parameters for the further course of the program can be delivered.

10 Claims, 4 Drawing Sheets

DEVICE FOR MEASURING THE TURBIDITY OF THE RINSING LIQUID IN A DISHWASHER

BACKGROUND OF THE INVENTION

1. Field of the Invention

The invention relates to a device for measuring the turbidity of the rinsing liquid in a dishwasher by means of a turbidity sensor.

2. Description of the Related Art

Dishwashers available on the market up to now increasingly include turbidity sensors for measuring the turbidity of the rinsing liquid and for influencing the course of a rinse program as a function of the turbidity value of the rinsing liquid. Many dishwashers of today include an upper and a lower spray plane with associated spray arms, which can be operated simultaneously or separately from one another in an alternating manner. At the same time, the rinsing liquid is circulated by a circulation pump where the rinsing liquid is supplied to the circulation pump via the water drain shaft. The output of the circulation pump is then connected alternately to the upper and lower spray arm.

SUMMARY OF THE INVENTION

It is an object of the present invention to specify, for a dishwasher of this type, a device for measuring the turbidity of the rinsing liquid. The device supplies measured values, which provides information on the quantity and type of the soiling of the rinsing liquid. The measured values can represent parameters which are used for influencing the rinsing program.

In an exemplary embodiment of the invention, this object may be achieved by incorporating a turbidity sensor into the inlet flow of the circulation pump in the water drain shaft of the dishwasher and continuously measuring the turbidity of the rinsing liquid. The upper and lower spray plane can be operated alternately and a difference value can be derived from the turbidity values associated with the upper and lower spray plane. The parameters for the quantity and the type of soiling can then be derived from the turbidity values and the difference value, and the rinse program can be established or modified based on these parameters.

By disposing the turbidity sensor in the inlet flow of the circulation pump in the water drain shaft of the dishwasher, there is no special measuring chamber for measuring the turbidity. The measuring is effected with the rinsing liquid circulating, without shutting-down the circulation pump, which means that the rinsing process is not disturbed. Over and above this, a clear determining of the turbidity can be derived from the two turbidity values of the upper and the lower spray plane. At the same time it can be considered that, with identical soiling of the rinsing liquid, the turbidity value when the upper spray plane is operated is smaller than the turbidity value when the lower spray plane is operated, as well as that the velocity of flow of the rinsing liquid when the upper spray plane is operated is less than the velocity of flow when the lower spray plane is operated.

If it is also provided that, the increase in the turbidity values is derivable, and in that the length of time until the increase in the turbidity values has achieved the value zero is determinable, then it is possible to make a statement on the solubility of the soiling of the dishes, which statement can be used as a parameter for the solubility of the soiling of the dishes in the rinsing program.

BRIEF DESCRIPTION OF THE DRAWINGS

The invention is described in more detail by way of diagrams. In which.

DETAILED DESCRIPTION

Figure 1:
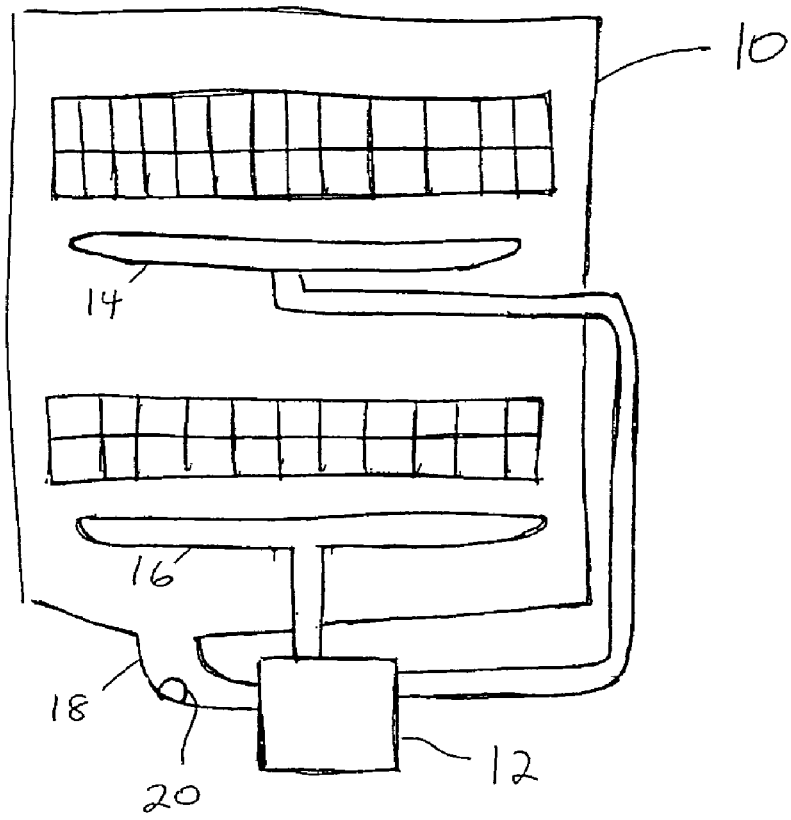
FIG. 1 is a schematic illustration of the dishwasher in accordance with the exemplary embodiment of the present invention.

In FIG. 1 there is shown a dishwasher having a tub 10. A circulation pump 12 is provided for supplying liquid to a first spray arm 14 operating in an upper spray plane and a second spray arm 16 operating in a lower spray plane. The pump may supply liquid either simultaneously or separately to each spray arm in an alternating manner. A water drain shaft or inlet shaft 18 supplies liquid to the circulation pump 12 which has outputs connected to the upper and lower spray arms 14 and 16, respectively. A turbidity sensor 20 is incorporated into the inlet shaft 18 such that the turbidity of the inlet flow into the pump is measured.

Figure 2:
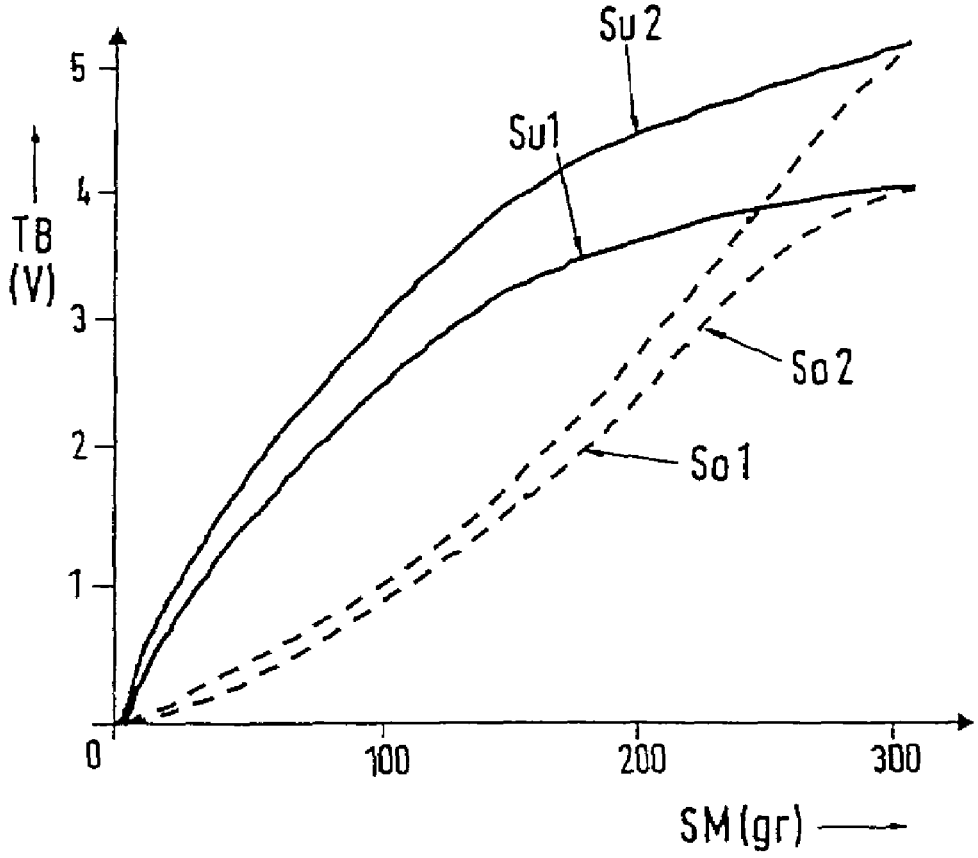
FIG. 2 is the turbidity as a function of the quantity of soiling.

In the diagram in FIG. 2, the turbidity TB is specified in volts of the electronic turbidity sensor as a function of the quantity SM of the soiling in grams. At the same time, the measured value for the turbidity TB, with the operation of the upper spray plane, is specified for two different types of soiling So1 and So2. The curves, identified as Su1 and Su2, specify the turbidity TB for two different types of soiling Su1 and Su2 with the operation of the lower spray plane. It can be deduced from the curves that between both turbidity values of the curves Su1 and So1, or respectively Su2 and So2, for each type of soiling a difference value can be derived which is a function of the type of soiling and the quantity SM of the soiling. The measuring of the turbidity according to the invention with the subsequent influencing of the rinsing program is based on this knowledge. It can also be derived from the curves Su1 and So1, or respectively Su2 and So2, that the turbidity sensor, with identical soiling, always emits a higher turbidity value TM when the lower spray plane is operated than when the upper spray plane is operated, i.e. Su1>So1 or respectively Su2>So2 and between both values there is a respective difference in the turbidity values, which increases with the quantity SM and then reduces again by the same quantity. Another parameter for influencing the rinsing program can be derived from the two curves Su1 and So1, or respectively Su2 and So2, which approximate at a maximum degree of soiling and do not increase any more.

The length of time elapsing from the beginning of the pre-rinse operation up to this moment is a measurement for the solubility of the soiling of the dishes, i.e. up to the moment when, without changing the operating conditions, no more soiling is dissolved from the dishes. Using an evaluation software, the values of the turbidity and their difference as well as the determined length of time, the quantity and the type of soiling on the dishes can be analyzed and established and can be used for adjusting and modifying the further course of the rinsing program.

Figure 3:
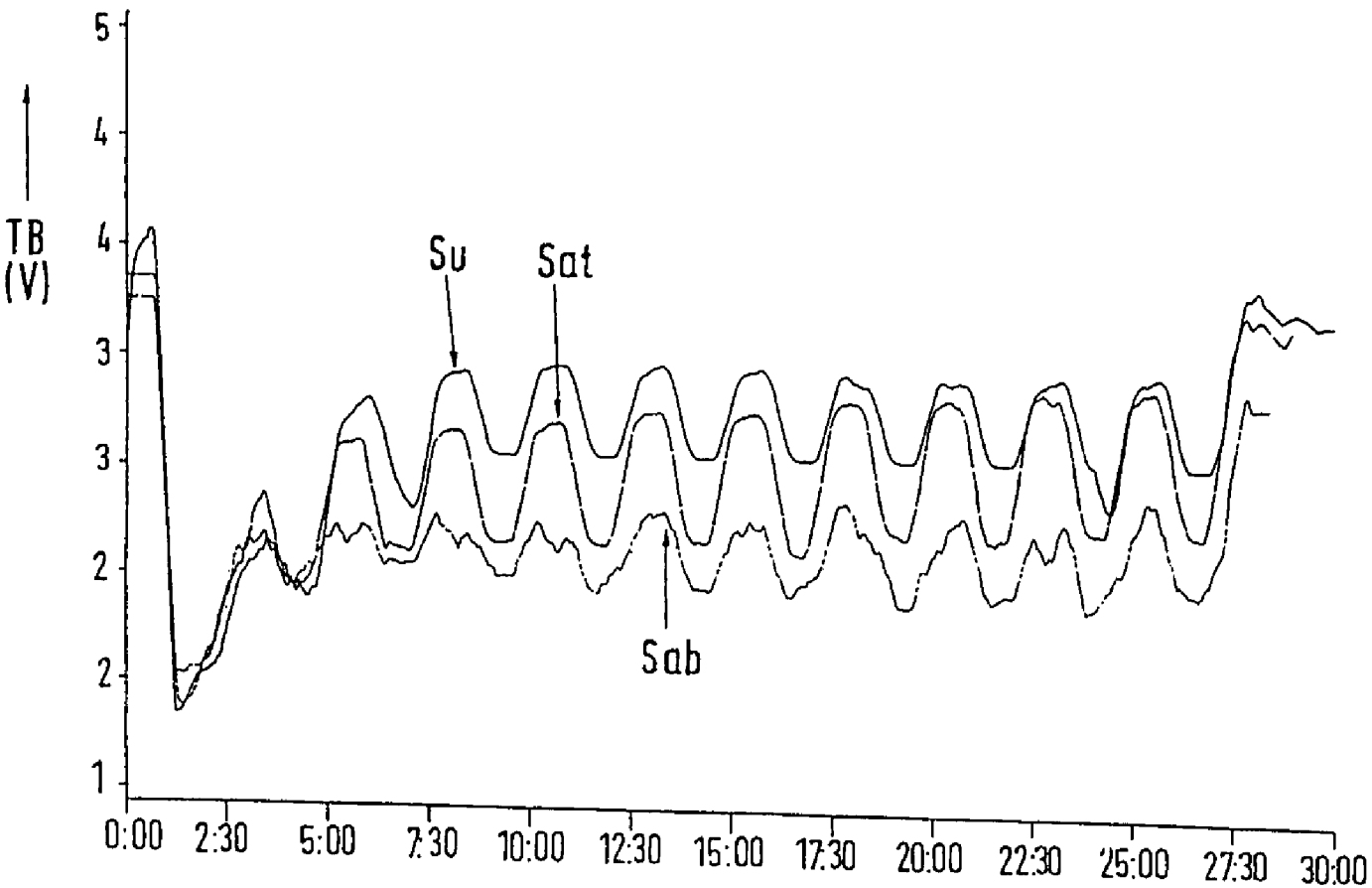
FIG. 3 is the quantity of soiling as a function of the length of time of the rinsing operation for various types of soiling and rinsing with hot water.
Figure 4:
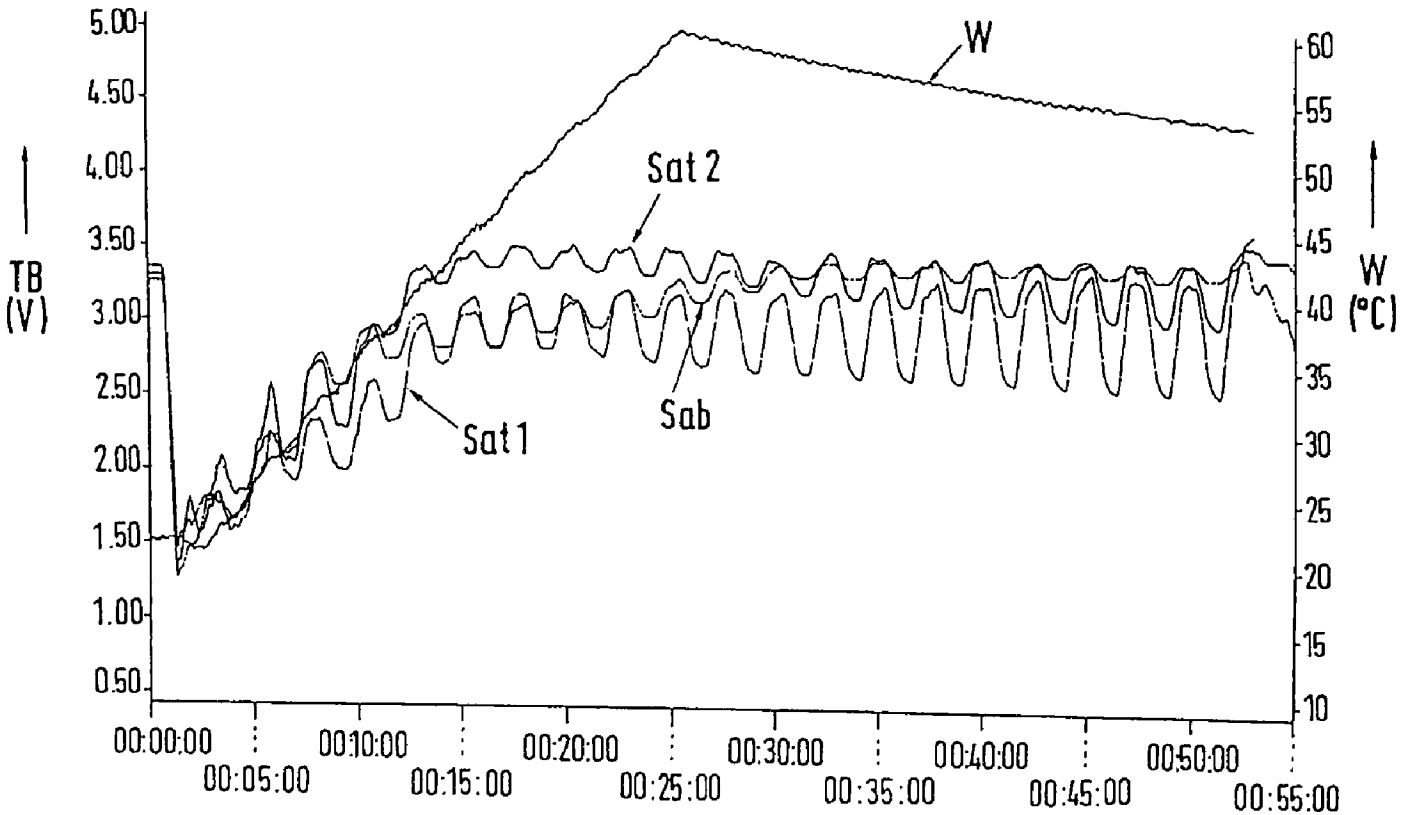
FIG. 4 is the quantity of soiling as a function of the length of time of the rinsing operation for various types of soiling and rinsing with cold water.

In FIGS. 3 and 4, each with three different types of soiling on the dishes, the turbidity values TB are shown as a function of the length of time T of the pre-rinse operation. The curves show a rhythmic up and down of the turbidity value TB, which is conditioned by the alternating starting-up of the lower and upper spray plane. At the same time, the higher turbidity value is associated with the respective lower spray plane and the lower turbidity value is associated with the respective upper spray plane. This is applicable to all curves Sab, Sat and Sll. Where the soiling is burnt-on, little soiling is dissolved in the period T of the pre-rinse operation, as is shown in the curve Sab. Where the soiling is dried-on, more soiling is dissolved in the same period T under the same conditions, as is shown in the curve Sat with higher turbidity values TB. Finally, where the soiling is easily dissolvable, even more soiling is dissolved, which results in an even higher turbidity level TB, as can be seen in the curve Sll. At the same time the maxima and minima of the curves are retained. Only the difference in the turbidity values TB of the various curves can change and can also be used to influence the further course of the rinsing program. It can also be deduced from the curves Sab, Sat and Sll that after a certain length of time, for example 10 to 15 minutes or respectively 20 minutes after the beginning of the pre-rinse operation, the turbidity values TB do not change any more. This can be evaluated as a sign that, without any change in the operating conditions and consequently the rinsing program, the cleaning of the dishes cannot be improved any more and therefore the rinsing program must be continued with consideration given to the determined turbidity values, the difference value of the turbidity values and the determined length of time.

The influence of the temperature of the rinsing liquid can also be seen in the curves in FIGS. 3 and 4. A rinsing liquid at a temperature of 15° C. is used in the tests with the three different types of soiling Sab, Sat and Sll in FIG. 3. In this case, less soiling is dissolved from the dishes than in the tests in FIG. 4 where hot water is used and this is reflected in the different turbidity values TB and various difference values in FIGS. 3 and 4.

Where hot water is used as the rinsing liquid, the turbidity factor TB does not oscillate very strongly with different types of soiling, even when the quantity of soiling is doubled, as is shown in the curve Sat2 compared to the curve Sat1 in FIG. 4. The course of the water temperature W is specified in ° C. for the pre-rinse operation by the curve, identified as such, and the associated right-hand abscissa W.

It can also be seen from the curves in FIGS. 3 and 4 that the turbidity values TB increase in a different manner at the beginning of the pre-rinse operation. An increase can be seen here for both the maxima (lower spray plane) and minima (upper spray plane). In the different curves the maxima and minima pass over into approximately constant values after variable times such that, depending on the soiling, the length of time taken until the increase in the turbidity values TB assume the value zero also changes. A statement on the type of soiling can be derived from this, both with cold rinsing liquid (15° C. bi FIG. 3) and with heated-up rinsing liquid (W in FIG. 4).

As is shown in FIGS. 3 and 4, with known types of soiling, tests can produce the parameters which are to be used for the continued course of the program in order to optimize a cleaning and drying operation for the dishes and to achieve this with the smallest power and water consumption. The values obtained in tests are deposited in the control unit and are called-up each time the dishwasher is operated as a function of the turbidity values, difference values and lengths of time, determined in the current pre-rinse operation, in order to establish the further course of the program.

We claim:

1. A dishwasher comprising:

a chamber for supporting items to be rinsed;

an upper spray plane and a lower spray plane located in the chamber and for delivering rinse liquid therefrom to the chamber;

a liquid delivery system fluidly configured to alternately supplying rinse liquid to the upper spray plane and the lower spray plane;

a turbidity sensor generating a turbidity signal indicative of the turbidity of the rinse liquid in the chamber;

a controller configured to control the liquid delivery system to selectively deliver rinse liquid to the upper and lower spray planes, receive the turbidity signal from the turbidity sensor, and lower spray planes, wherein the controller determines an actual difference value between each of the actual turbidity values for the upper and lower spray planes, and establish operational parameters for a rinse cycle based upon the actual difference value.

2. The dishwasher according to claim 1 wherein the controller is further configured to determine an actual time value at which a change in the sensed turbidity of the rinse liquid delivered by one of the upper spray plane and the lower spray plane equals zero.

3. An apparatus according to claim 2 wherein the controller is further configured to store at least one of a preselected turbidity value, difference value, and time value representative of a preselected soiling value of items to be rinsed, and to establish operational parameters for a rinse cycle from at least one of the preselected turbidity value, difference value, and time value and at least one of the actual turbidity value, difference value, and time value.

4. An apparatus according to claim 3 wherein the controller is further configured to derive a parameter for a solubility of soiling of the items to be rinsed from the actual time value.

5. An apparatus according to claim 4 wherein the controller is further configured to operate the rinse cycle based upon the parameter for solubility.

6. The device according to claim 1, wherein the turbidity value associated with the upper spray plane is smaller than the turbidity value associated with the lower spray plane when the soiling of the rinsing liquid is identical.

7. The device according to claim 6, wherein a velocity of the flow of the rinsing liquid when the upper spray plane is operated is less than a velocity of the flow when the lower spray plane is operated.

8. The device according to claim 1, wherein an increase in the turbidity values is derivable from a length of time it takes until a rate of change in turbidity values has achieved a zero value.

9. The device according to claim 8, wherein a parameter for a solubility of a soiling of dishes is derivable from the length of time.

10. The device according to claim 9, wherein the continued course of the rinsing program can be established and controlled with the parameter for the solubility of the soiling of the dishes.

* * * * *